US005727376A

United States Patent [19]

Bäckman

[11] Patent Number: 5,727,376

[45] Date of Patent: Mar. 17, 1998

[54] METHOD AND A BLANK FOR THE PRODUCTION OF HORSESHOES

[75] Inventor: Clemens Bäckman, Gustafs, Sweden

[73] Assignee: MCL i Avesta AB, Sweden

[21] Appl. No.: 737,092

[22] PCT Filed: Apr. 28, 1995

[86] PCT No.: PCT/SE95/00471

§ 371 Date: Nov. 1, 1996

§ 102(e) Date: Nov. 1, 1996

[87] PCT Pub. No.: WO95/30329

PCT Pub. Date: Nov. 16, 1995

[30] Foreign Application Priority Data

May 4, 1994 [SE] Sweden ..... 9401534

[51] Int. Cl.[6] ..... A01L 1/00; B21K 15/02

[52] U.S. Cl. ..... 59/62; 59/36; 168/4; 168/11

[58] Field of Search ..... 59/36, 37, 38, 59/44, 61, 62, 70; 168/4, 11, 12, DIG. 1

[56] References Cited

U.S. PATENT DOCUMENTS

| | | | |
|---|---|---|---|
| 970,267 | 9/1910 | Schwartz | 168/11 |
| 1,468,196 | 9/1923 | Curzon | 168/11 |
| 2,679,906 | 6/1954 | McGraw et al. | 168/24 |
| 4,760,885 | 8/1988 | Benning | 168/11 |
| 5,353,878 | 10/1994 | Lee | 168/DIG. 1 |

FOREIGN PATENT DOCUMENTS

| | | | |
|---|---|---|---|
| 5-84035 | 4/1993 | Japan | 168/4 |

*Primary Examiner*—David Jones

[57] ABSTRACT

A method and a blank for the production of horseshoes. The blank being made from a plane of plate the length and width of which are many times larger than its thickness and which is composed of at least two part-plates of differently hard materials which are joined to each other by explosion welding, the harder material forming an external lamina and the softer material an internal lamina in the finished, substantially U-shaped shoe.

10 Claims, 2 Drawing Sheets

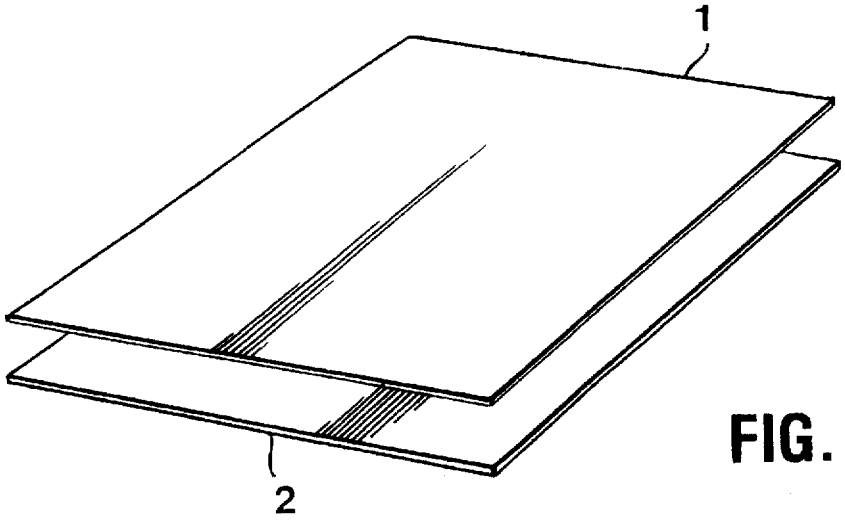
FIG. 1
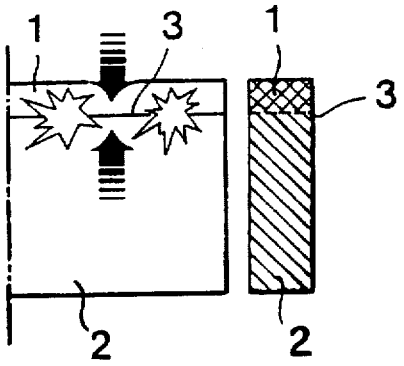
FIG. 3
FIG. 2
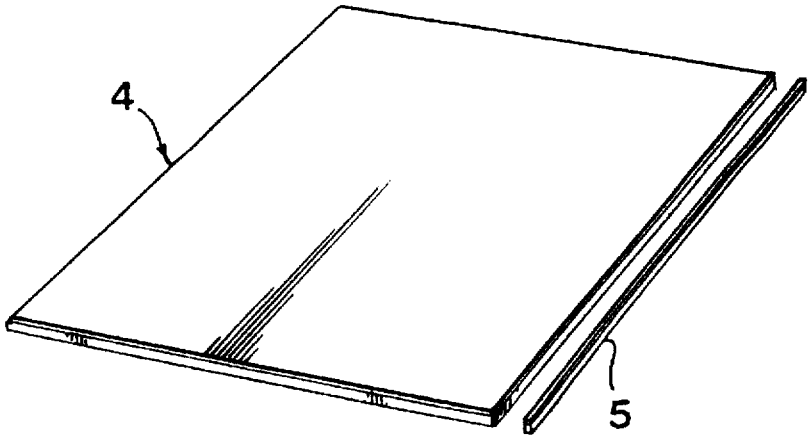

METHOD AND A BLANK FOR THE PRODUCTION OF HORSESHOES

TECHNICAL FIELD OF THE INVENTION

In a first aspect, the present invention relates to a method for the production of horseshoes from an initial blank in the form of a plane plate the length and width of which are many times larger than its thickness and which is composed of at least two part-plates of differently hard materials which are joined to each other by explosion welding, the harder material forming an external lamina and the softer material an internal lamina in the finished, substantially U-shaped shoe.

PRIOR ART

From SE 8603894-0 it is previously known to produce horseshoes from an initial blank composed of two part bodies of different metals which are intimately joined to each other by explosion welding. According to an embodiment described in said patent, these part bodies consist of two tubes which are concentrically arranged in each other. According to another embodiment, the part bodies consist of metal plates which together form a plate body that is bent to a groove or tube shape, before the production of the individual horseshoes is initiated. In both cases, this production is effected by cutting or sawing the groove- or tube-shaped blank in transverse cuts, whose internal axial distances correspond to the desired thickness of the horseshoe. Advantageously, metals used for the composite unit may be steel and aluminum, the steel forming an external, thin and hard lamina with good wear resistance and good gripping properties, while the internally located aluminum material forms a wider and softer lamina which confers a low weight to the shoe in its entirety by the small density of the material. Thus, the advantages of the ready shoe are that it has both a low total weight and a long life, at the same time as the joint effected by explosion welding between the two different laminae gives a very reliable connection of the laminae, thereby avoiding any risk of a delamination.

However, a serious disadvantage of the manufacturing method described in SE 8603894-0 is that the individual shoes are produced by a section-wise separation of the end portions of a groove- or tube-shaped blank, whose cross-sectional shape substantially corresponds to the contour form of the prospective shoe. For most farriers, e.g. those being active at trotting and riding stables, there is a necessity of being able to shoe horses with most varying hoof sizes. Thus, in practice no less than about twenty different shoe sizes exist, all the way from shoes for the smallest breeds to shoes for the biggest breeds, the largest shoe being 4 to 5 times larger than the smallest one (a pony shoe may have a bow length from end to end smaller than 15 cm, while the corresponding bow length of the largest shoe may amount to a size of 50 cm). The consumption of different shoes for both one and the same, and for different farriers, may vary quite considerably over time. Periodically, shoes of a certain size may be produced in large amounts, while at the same time other sizes are not at all requested, or only to a small degree. During other periods the circumstances may be reversed. These fluctuations, which are impossible to predict for the farrier, cause storage problems that are difficult to master, irrespective of whether the groove or tube blank is immediately divided into a maximum number of shoes (e.g., 50 to 100 shoes per blank) or is stored in order to enable a separation of shoes one by one, as need emerges. In order to satisfy the requirements of different farriers, one has to store about twenty different types of voluminous blanks and/or sets of shoes, this being both costly and bulky. A further disadvantage of especially the groove-shaped blank, is that it requires rather strong and thus expensive bending machines. Moreover, both longer and shorter transports of groove-shaped and tube-shaped blanks from a central producer to geographically scattered buyers are rather costly because of the fact that the major part of the volume of the blanks consists of an empty cavity.

OBJECTS AND CHARACTERISTICS OF THE INVENTION

In a first aspect, the present invention aims at setting aside the above mentioned disadvantages of the previously known method and at providing a manufacturing method that makes possible an effectual storage of the required blanks, as well as effectual transports thereof. Thus, a primary object of the invention is to create possibilities of storing and transporting horseshoe blanks tightly to each other without any bulky cavities in connection with the same. A further object is to provide a manufacturing method according to which one and the same blank can be used for the production of shoes of most varying bow lengths. Another object of the invention is to provide a method which does not necessitate any strong and thus costly bending machines.

According to the invention, at least the primary object is attained by the features defined in the characterizing clause of claim 1. Further, preferred embodiments of the method according to the invention are defined in dependent claims 2 to 3.

According to a second aspect, the invention also relates to a blank per se. The features of this new blank are defined in claim 4.

BRIEF DESCRIPTION OF THE APPENDED DRAWINGS

In the drawings

FIG. 1 is a perspective view illustrating two part-plates intended to jointly form an initial blank, FIG. 2 is a similar perspective view showing the initial blank in a composite condition, at the same time as an intermediate blank has been separated therefrom, FIG. 3 is a partial side-view of the initial blank and a section of the intermediate blank in a very enlarged scale, FIG. 4 is a partial perspective view showing the intermediate blank according to FIG. 2 during the separation of a final blank, FIG. 5 is an enlarged perspective view of a final blank that has been provided with a groove, FIG. 6 is a perspective view of a finished horseshoe, showing the underside thereof, and FIG. 7 is an enlarged cross-section through the finished horseshoe.

DETAILED DESCRIPTION OF A PREFERRED EMBODIMENT OF THE INVENTION

Figure 4:
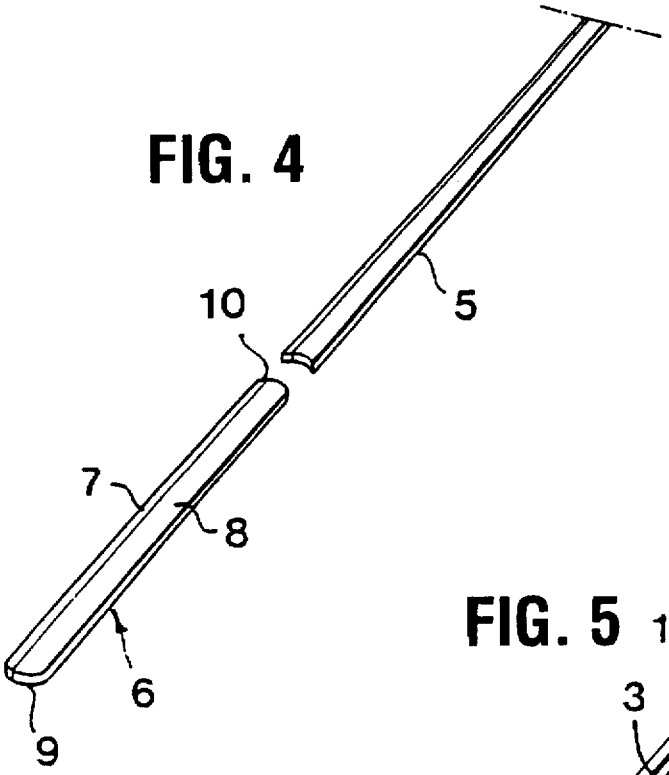

FIG. 1 depicts two part-plates 1,2 intended to be joined to each other to form an initial blank. Advantageously, the plates have equally large surfaces, while differing in thickness. In practice, the plates may have a length of for instance 1,5 m and a width within the range of 1,0 to 1,5 m, although these measures may vary both upwardly and downwardly. Advantageously, the thinner plate 1 may be made of steel or another relatively hard and wear-resistant metal, while the thicker plate 2 preferrably consists of aluminum, although also other light metals are feasible. Even if the thicknesses of the two plates may vary within wide ranges, the steel plate 1 suitably has a thickness within the range of 2 to 5, preferrably 3 to 4 mm, while the thickness of the aluminum plate 2 may be within the range of 7 to 20, preferrably 10 to 15 mm. As indicated to the left in FIG. 3, the plates 1,2 may be joined by explosion welding in a way known per se, thereby effecting an intimate connection of the same in the area of an interface designated 3. However, it should be emphasized that an intimate connection between the plates may also be brought about in other ways than just by explosion welding, e.g., by gluing, other welding, such as sound welding, etc. It is even thinkable to use a joining technique in the future, which was still not known at the time the invention was made. Essential is only that the two part-plates 1,2 be joined so intimately with each other that they do not run the risk of delaminating in the finished horseshoe.

In FIG. 2, reference numeral 4 designates the plane plate that is formed by the joining of the two part-plates 1,2. This plane plate forms an initial blank for the continued manufacturing.

According to the invention, the plane initial plate 4 is, in a first step, divided into a plurality of separate, elongated intermediate blanks 5 of which one is shown in FIG. 2. The parting-off of these intermediate blanks 5 is most advantageously made along a longitudinal side of the initial plate in case this plate has a rectangular form, whereby the intermediate blank obtains the largest possible length. For this parting-off, any known or arbitrary technique may be used, such as sawing with a circular saw blade, cutting by laser, cutting by water jet or similar. The parting-off is made in cuts which are perpendicular relative to the plane of initial plate 4, whereby the separated intermediate blank obtains a substantially parallelepipedical basic shape. The width of this parallelepipedical body corresponds to the thickness of the initial plate 4, while the thickness of the body is selected in such a way that it is always smaller than the blank width. The selection of thickness is made by locating the cuts between the individual intermediate blanks 5 at suitable distances from each other. For the sake of completeness, it is pointed out than plate 4 is divided into separate intermediate blanks 5 in its entirety, suitably in identically similar blanks.

Now reference is made to FIG. 4 which in an enlarged condition shows an intermediate blank 5 from which, in a second step, a final blank designated 6 has been parted off. In this final blank 6, reference numeral 7 designates an external lamina consisting of the steel material, while 8 designates an internal lamina of aluminum. At the parting-off from the straight intermediate blank 5, the final blank 6 is given a length corresponding to the bow length from end to end of the finished shoe. In connection with the parting-off of the final blank 6 from the intermediate blank 5, the final blank is suitably also submitted to a punching operation which confers rounded ends 9,10 to the blank.

Figure 5:
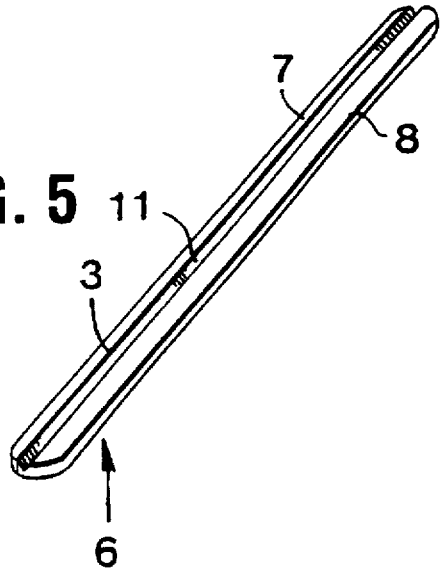

According to a preferred embodiment of the invention, a grip-enhancing groove 11 of the sort illustrated in FIG. 5 is milled in the final blank. More specifically, the groove 11 is milled out in the internal, softer lamina 8 in the immediate proximity of interface 3 between the two laminae. That side of final blank 6 in which the groove is milled out, forms the underside of the finished shoe. In practice, the groove may be V-shaped cross-sectionally, although also other cross-sectional forms are feasible, such as circular. For special shoes it is possible to give the groove 11 a length that is smaller than the total length of the final blank 6, the groove being terminated at a distance from the two opposed ends of the final blank, thus leaving plane lower surfaces in the area of these ends. In the plane surfaces thus obtained one may drill threaded holes for fastening grip-enhancing taps or spikes of the type that is conventionally used on winter-shoed horses.

Figure 7:
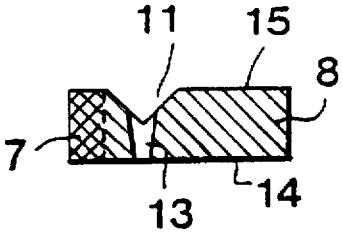
Figure 6:
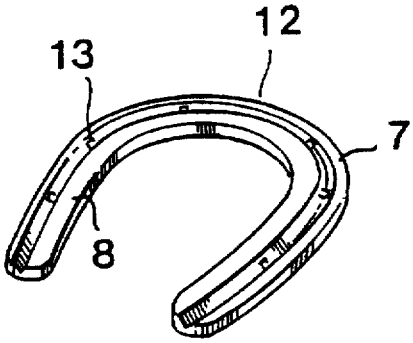

In a terminating third step, the final blank 6 is bent to a horseshoe with a U-formed contour as illustrated in FIG. 6. This bending is performed in a medium-size bending machine (not shown) appropriate for the purpose. In or in connection with the bending machine, the finished shoe, which is designated by reference numeral 12, is provided with the necessary nail-holes 13. The nail-holes are most advantageously obtained by punching and are suitably placed in connection to groove 11. As may be seen in FIG. 7, the individual nail-hole 13 widens in a way known per se from the shoe's upper side, which is designated by reference numeral 14, towards the underside 15. Most advantageously, the holes are placed along the bow-shaped line that is formed by the bottom of groove 11. In case the shoe is also to be provided with threaded holes of the type indicated above, this is suitably realized in connection with the working operation at which nail-holes 13 are formed.

It is also possible to provide the finished shoe with a so called toe cap (not shown). This toe cap is fastened at the front of the shoe, more specifically on the external lamina 7 of steel, with the toe cap protruding from the upper side 14 of the shoe. The toe cap may for instance consist of a triangularly shaped piece of plate which is welded or riveted upon the external lamina 7.

The advantages of the invention should be evident. As required, final blanks may be parted off from the straight, elongated blank 5, said final blanks being of an arbitrary, individually adjusted length which is suited to the final bending of shoes of most varying sizes. The thin and straight blanks 5 may be stored and transported with a minimum of required space, at the same time as the blanks have low weight and may be handled in a simple and smooth way.

FEASIBLE MODIFICATIONS OF THE INVENTION

It is evident that the invention is not restricted solely to the embodiment as described and shown in the drawings. Thus, it is possible to compose the initial plate 4 of more than two part-plates, thereby obtaining three or more laminae of different materials in the finished horseshoe. Further, it is feasible to mill or form the grip-enhancing groove not only in the final blank but already in the intermediate blank that is parted off from the initial plate. For the sake of completeness, it should also be pointed out that the width of the finished shoe may of course be varied by selecting differently thick part-sheets or -plates in the initial plate 4.

I claim:

1. A method for the production of horseshoes from an initial blank, said initial blank being in the form of a planar plate having a length and width greater than a thickness dimension, comprising:

at least two partial plates of materials having a different hardness relative to each other, said materials being joined to each other by explosion welding, a harder material forming an external lamina and a softer material of said materials forming an internal lamina, wherein said initial blank, in a first step, is divided into a plurality of individual, elongate intermediate blanks, each intermediate blank of said intermediate blanks having a width corresponding to the thickness of said initial blank and a thickness less than the width of said initial blank, each said initial blank, in a second step, being cut into a length corresponding to a desired shoe size to thus form several final blanks, each final blank of said final blanks having opposed ends; and bending, in a third step, each final blank of said final blanks into a U-shaped shoe.

2. The method according to claim 1, further including the step of milling a grip enhancing groove in said final blank or said intermediate blank.

3. The method according to claim 2, wherein said grip enhancing groove is milled between said external lamina and said internal lamina.

4. The method according to claim 3, wherein said internal lamina has an underside and each said lamina has a border surface, said grip enhancing groove being milled in said underside of said internal lamina approximate said border surface of each said lamina.

5. The method according to claim 4, wherein said groove has a length less than a total length of said final blank, said groove terminating in advance of said opposed ends of each final blank to thereby provide a planar surface at each opposed end.

6. A blank suitable for the production of horseshoes in accordance with claim 5, wherein said blank has an elongate body including a planar initial plate composed of at least two partial plates of materials having different hardness, said partial plates being joined to each other at an interface formed by explosion welding, said body having a length several times greater than a bow length of a horseshoe, said body having a rectangular cross-section, said width of said body corresponding to said thickness of said initial plate, said thickness being smaller than said width.

7. A blank suitable for the production of horseshoes in accordance with claim 2, wherein said blank has an elongate body including a planar initial plate composed of at least two partial plates of materials having different hardness, said partial plates being joined to each other at an interface formed by explosion welding, said body having a length several times greater than a bow length of a horseshoe, said body having a rectangular cross-section, said width of said body corresponding to said thickness of said initial plate, said thickness being smaller than said width.

8. A blank suitable for the production of horseshoes in accordance with claim 3, wherein said blank has an elongate body including a planar initial plate composed of at least two partial plates of materials having different hardness, said partial plates being joined to each other at an interface formed by explosion welding, said body having a length several times greater than a bow length of a horseshoe, said body having a rectangular cross-section, said width of said body corresponding to said thickness of said initial plate, said thickness being smaller than said width.

9. A blank suitable for the production of horseshoes in accordance with claim 4, wherein said blank has an elongate body including a planar initial plate composed of at least two partial plates of materials having different hardness, said partial plates being joined to each other at an interface formed by explosion welding, said body having a length several times greater than a bow length of a horseshoe, said body having a rectangular cross-section, said width of said body corresponding to said thickness of said initial plate, said thickness being smaller than said width.

10. A blank suitable for the production of horseshoes in accordance with claim 5, wherein said blank has an elongate body including a planar initial plate composed of at least two partial plates of materials having different hardness, said partial plates being joined to each other at an interface formed by explosion welding, said body having a length several times greater than a bow length of a horseshoe, said body having a rectangular cross-section, said width of said body corresponding to said thickness of said initial plate, said thickness being smaller than said width.

* * * * *